US007127796B2

(12) United States Patent
Mukuda et al.

(10) Patent No.: US 7,127,796 B2
(45) Date of Patent: Oct. 31, 2006

(54) METHOD OF MANUFACTURING A WAVEGUIDE

(75) Inventors: Muneaki Mukuda, Tokyo (JP); Takayuki Inuzuka, Tokyo (JP); Naosi Yamada, Tokyo (JP); Hideki Asao, Tokyo (JP); Kazuhisa Henmi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 537 days.

(21) Appl. No.: 10/333,359

(22) PCT Filed: Jun. 10, 2002

(86) PCT No.: PCT/JP02/05742

§ 371 (c)(1),
(2), (4) Date: Jan. 21, 2003

(87) PCT Pub. No.: WO03/005482

PCT Pub. Date: Jan. 16, 2003

(65) Prior Publication Data

US 2003/0106203 A1 Jun. 12, 2003

(30) Foreign Application Priority Data

Jul. 6, 2001 (JP) ..... 2001-206770

(51) Int. Cl.
*H01P 11/00* (2006.01)
*H01P 1/04* (2006.01)

(52) U.S. Cl. ..... 29/600; 29/593; 29/601; 29/831; 29/840; 333/254

(58) Field of Classification Search ..... 29/601, 29/600, 593, 831, 840; 343/700 R, 821, 343/822, 795; 333/239, 248, 254; 156/150, 156/292
See application file for complete search history.

(56) References Cited

U.S. PATENT DOCUMENTS

| | | | | |
|---|---|---|---|---|
| 4,020,875 | A | 5/1977 | Akiba | |
| 4,499,157 | A | 2/1985 | Mulliner et al. | |
| 5,219,377 | A * | 6/1993 | Poradish | 29/830 |
| 5,380,386 | A * | 1/1995 | Oldham et al. | 156/150 |
| 5,398,010 | A * | 3/1995 | Klebe | 333/239 |
| 6,239,669 | B1 * | 5/2001 | Koriyama et al. | 333/26 |

FOREIGN PATENT DOCUMENTS

| | | |
|---|---|---|
| JP | 57-72602 U | 5/1982 |
| JP | 7-326910 A | 12/1995 |
| JP | 2001-53509 A | 2/2001 |

* cited by examiner

*Primary Examiner*—A. Dexter Tugbang
*Assistant Examiner*—Tai Van Nguyen
(74) *Attorney, Agent, or Firm*—Leydig, Voit & Mayer, Ltd.

(57) ABSTRACT

A method of manufacturing a waveguide includes forming two waveguide units, each waveguide unit having a channel defined by a bottom wall and two side walls generally transverse to the bottom wall, flanges extending from the side walls, outside the groove, transverse to the side walls and generally parallel to the bottom wall, the flanges including though holes; joining the two waveguide units to each other so that the flanges of a first of the waveguide units abut the flanges of a second of the waveguide units, with the grooves forming a channel for guiding waves; and, by insert molding, forming a thermoplastic resin cover that fills the through holes in the flanges and covers both of the first and second waveguide units, at least partially.

16 Claims, 4 Drawing Sheets

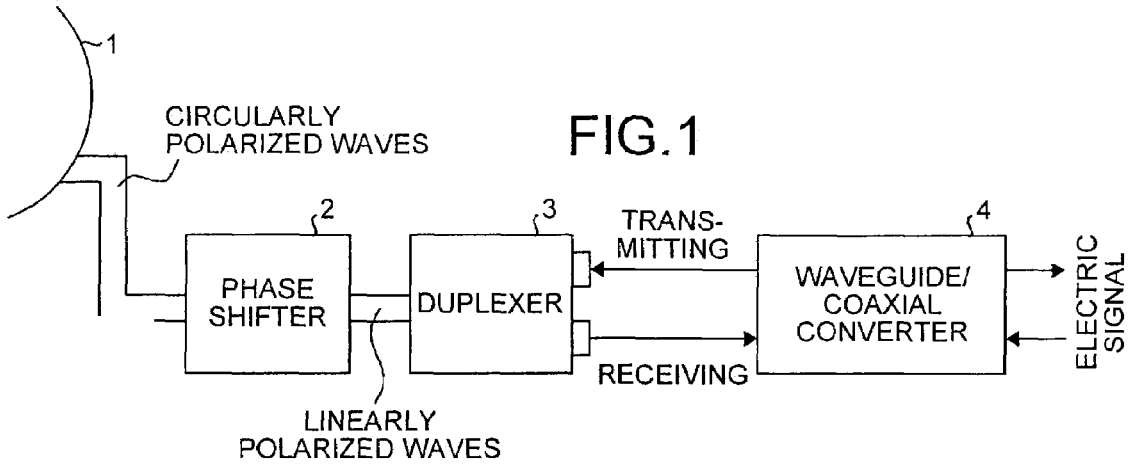
FIG.1
FIG.2
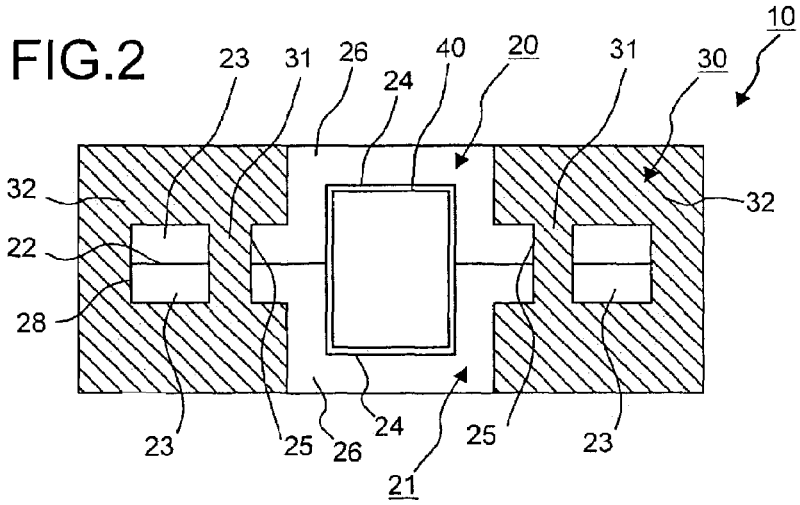
FIG.3
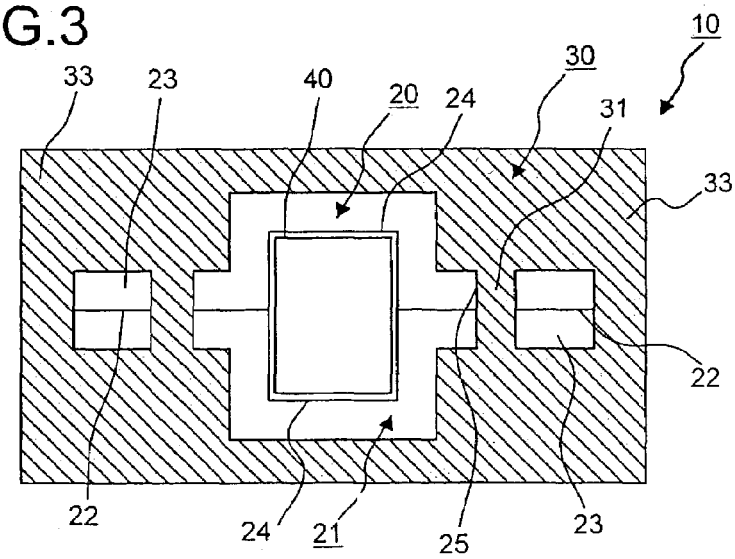

METHOD OF MANUFACTURING A WAVEGUIDE

TECHNICAL FIELD

The present invention relates to a microwave waveguide (hereinafter "waveguide") including a pair of waveguide units, and a manufacturing method thereof.

BACKGROUND ART

Though it was common to make the microwave waveguides with metal, recently, they have also been made of resins.

FIG. 7 shows a prior art waveguide made of a resin (Japanese Patent Application Laid-Open No. 6-104615). This prior art waveguide is manufactured as follows. That is, a base 101 is made of a thermoplastic and, this base 101 has a U-shaped hollow-space 100. Moreover, a cover 103 is also made of a thermoplastic and this cover 103 also has a U-shaped hollow-space 102. The base 101 and the cover 103 are bonded with an epoxy adhesive to form a waveguide 104. A layer of copper is formed on the inner surface of the waveguide 104 by electroless-plating.

In the prior art waveguide, floatings and steps are generated in the base 101 and the cover 103. In other words, the adhesive strength of the adhesive is not sufficient to keep the base 101 and the cover 103 together. To solve this problem and to more tightly hold the base 101 and the cover 103 together, taking into consideration that the waveguide is used in antennas that are installed outdoor and are required to withstand adverse conditions, nuts and bolts (or screws) are provided that hold the base 101 and the cover 103. However, the nuts and bolts make the assembly of the waveguide troublesome.

To correct form errors of a groove (the hollow space) for a waveguide, and deformations of the groove caused by assembling of waveguide units, it is required to adjust a space volume in the inner faces of the groove by using a large number of screws.

It is an object of this invention to produce a waveguide that is easy to assemble, has stronger fastening force between waveguide units, and is air-tight.

It is another object of the present invention to produce a waveguide in which form errors of the groove for the waveguide are fewer, and that can be more efficiently manufactured.

DISCLOSURE OF THE INVENTION

The manufacturing method according one aspect of the present invention is for manufacturing a waveguide. The waveguide includes two waveguide units that are joined together. Each waveguide unit of the waveguide has flanges at both sides such that the flanges of one of the waveguide units are caused to abut on the flanges of the other waveguide unit. Each waveguide unit has a groove at a center portion for guiding waves. An inner wall of the groove is metal-plated. The method comprises forming the waveguide units having through holes in the flanges; and forming a resin cover that fills in the through holes and covers the waveguide units at least partially by, after joining the waveguide units, insert molding the joined waveguide units with a thermoplastic resin.

The waveguide according another aspect of the present invention includes two waveguide units that are joined together. Each waveguide unit has flanges at both sides. The flanges of one of the waveguide units abut the flanges of the other waveguide unit. Each waveguide unit has a groove at a center portion for guiding waves. An inner wall of the groove is metal-plated. This waveguide is manufactured in a method that comprises forming the waveguide units having through holes in the flanges; and forming a resin cover that fills the through holes and covers the waveguide units, at least partially by, after joining the waveguide units, by insert molding the joined waveguide units with a thermoplastic resin.

BRIEF DESCRIPTION OF THE DRAWINGS

FIG. 1 is a block diagram that shows a microwave antenna that includes a waveguide manufactured according to embodiments of the present invention;

FIG. 2 is a cross sectional view of a rectangular waveguide manufactured according to a first embodiment of the present invention;

FIG. 3 is a cross sectional view of a rectangular waveguide manufactured according to a second embodiment of the present invention;

BEST MODE FOR CARRYING OUT THE INVENTION

Figure 4:
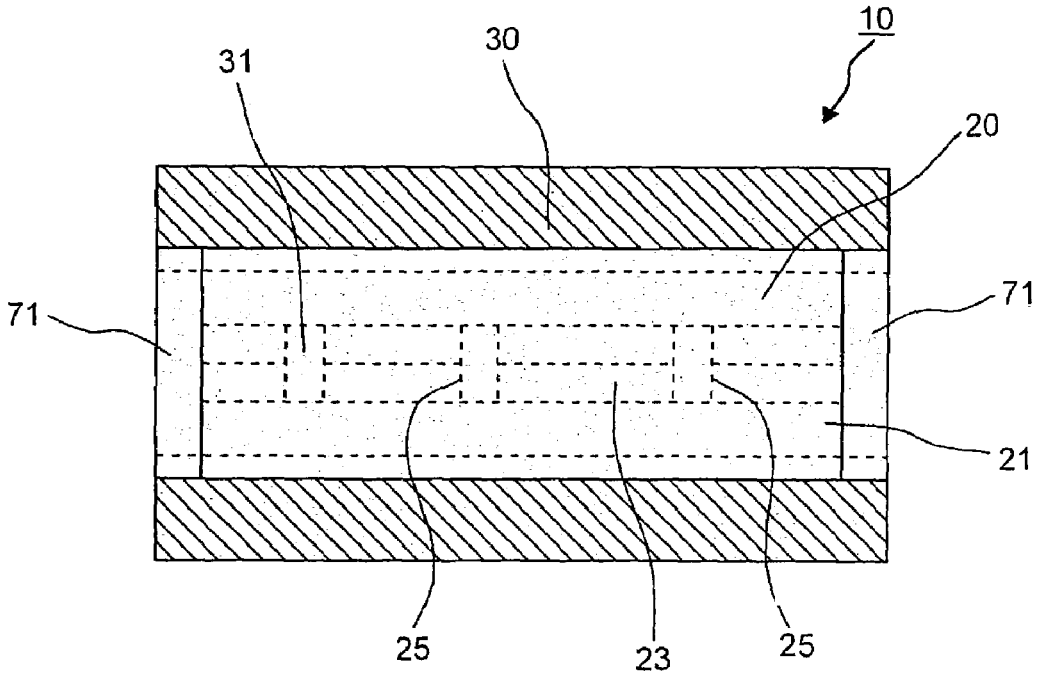
FIG. 4 is a cross sectional view of a rectangular waveguide manufactured according to the third embodiment of the present invention.

Exemplary embodiments of the waveguides according to the present invention and the manufacturing methods thereof are explained in detail below.

A waveguide manufactured according to the present invention is used, for example, in a duplexer 3, shown in FIG. 1, in a microwave antenna provided in a ground station for satellite communication. The microwave antenna can transmit and receive microwave signals.

The microwave antenna shown in FIG. 1 has a parabola antenna with a reflecting mirror 1. There is a 90-degree phase shifter 2 that converts the circularly polarized waves that are reflected from the reflecting mirror 1 into linearly polarized waves, and converts the linearly polarized waves that are output from the duplexer 3 into circularly polarized waves. The duplexer 3 has a branched waveguide and is used for transmitting and receiving electromagnetic waves according to their frequencies or phases. There is a waveguide/coaxial converter 4 that converts electromagnetic waves with a waveguide mode that propagate in the waveguide of the duplexer 3 into ones with a TEM mode for a microstrip line, and that converts the mode of electromagnetic waves from the microstrip line from the TEM one into the waveguide one. The duplexer 3 has a short-circuit board (not shown) that comprises a metal plate.

First Embodiment

FIG. 2 shows a cross sectional view of a rectangular waveguide 10, used in the duplexer 3, according to the first embodiment of the present invention. This waveguide 10 comprises a pair of waveguide units 20 and 21, and a resin cover 30 that surrounds and covers the waveguide units 20 and 21.

The waveguide units 20 and 21 are made of a metal such as aluminum, and they have the same thickness. Each of the waveguide units 20 and 21 has flange portions 23 that include a matching face 22 at both side portions such that the flange portions of one of the waveguide units are caused to abut on the flange portions of the other, and comprises groove forming sections 26 in which a rectangular groove 24 for the waveguide is formed at the center portion. The groove forming sections 26 are protruding from the flange portion 23. One or a plurality of through holes 25 are formed along the waveguide in the flange portions 23 formed at each side portion, respectively. A hollow body for the waveguide is formed by joining the pair of the waveguide units 20 and 21 with the configuration together so that their matching faces 22 rest on each other.

The inner wall faces of the hollow body obtained by joining the pair of the waveguide units 20 and 21 together are coated with metal plating 40 such as gold one, nickel one, and copper one. The resin cover 30 comprises portions 31 with which the through holes 25 are in filled, and portions 32 that cover the outer faces of the flange portions 23 in the waveguide units 20 and 21, and the outer side faces of the groove forming sections 26. In this case, the outer side faces of the groove forming sections 26 in the waveguide units 20 and 21 are exposed to the outside, as a weather-resistant metal (for example, aluminum) is used for the waveguide units 20 and 21. Obviously, the outer side faces of the groove forming sections 26 may be also covered with the resin cover 30.

The waveguide 10 shown in FIG. 2 is manufactured with the following method.

(1) Making Waveguide Units with Through Holes

The waveguide units 20 and 21 with the groove 24 shown in FIG. 2 are formed by suitable metal processing such as press working. Further, the through holes 25 are formed along the groove 24 in the flange portions 23 of the waveguide units 20 and 21.

(2) Plating

The inner wall faces of the groove forming sections 26 in the waveguide units 20 and 21, that is, the inner wall faces of the waveguide 10 are coated with the metal plating 40 such as gold one, nickel one, and copper one.

(3) Molding of Resin Cover

After joining the pair of the waveguide units 20 and 21, in which the through holes have been formed, together, the pair of the waveguide units 20 and 21 joined together are arranged in a mold of a cavity shape corresponding to that of the waveguide 10. Then, the resin cover 30 that comprises, as shown in FIG. 2, portions 31 filled into the through holes 25, and portions 32 that cover the outer faces of the flange portions 23 in the waveguide units 20 and 21, and the outer side faces of the groove forming sections 26 is formed by insert molding executed using a thermoplastic resin such as a polycarbonate resin with excellent weather-resistance. By the resin cover 30, the pair of the waveguide units 20 and 21 are fastened from the outside, and wind and rain are prevented from entering into the inside of the waveguide 10.

In the first embodiment, the through holes 25 are formed on the flange portions 23 of the waveguide units 20 and 21, and the waveguide units are joined together. Thereafter, insert molding of the pair of the joined waveguide units 20 and 21 is executed using a thermoplastic resin to form the resin cover 30. By the resin cover 30, the pair of the waveguide units 20 and 21 are fastened with the resin at the flange portions 23 located at the side portions, and the matching faces 22 of the waveguide units 20 and 21 are also configured to be protected from, for example, wind and rain at the outside. Accordingly, assembling of a waveguide without using screws can be realized, and assembling efficiency may be improved, based on the first embodiment. Furthermore, the fastening force between the waveguide units 20 and 21 is increased, and the air-tightness and the electrical sealing may be improved, as the contact pressure between the matching faces 22 is increased by shrinkage of the resin filled into the through holes 25.

Second Embodiment

FIG. 3 shows a waveguide 10 according to the second embodiment of the present invention. This rectangular waveguide 10 also comprises the waveguide units 20 and 21, and the resin cover 30 that surrounds and covers the waveguide units 20 and 21.

The waveguide units 20 and 21 of the second embodiment are made of a resin material, with excellent adhesion for plating, such as styrene resin (for example, ABS). Moreover, the resin cover 30 is configured to cover the entire outer faces of the waveguide units 20 and 21, as the waveguide units 20 and 21 are formed of the resin. The other portions except the portions are similar to those of the previous first embodiment.

The waveguide 10 shown in FIG. 3 is manufactured with the following method.

(1) Making Waveguide Units with Through Holes

The waveguide units 20 and 21 shown in FIG. 3, with the groove 24 and the through holes 25 are formed by injection molding. In such a case, the resin material used for the waveguide units 20 and 21 is a resin material with excellent adhesion for plating such as a styrene resin (for example, ABS). Polystyrene, high impact polystyrene, styrene-acrylonitrile copolymer, styrene-methyl-methacrylate copolymer, styrene-acrylonitrile-methyl-methacrylate copolymer, ABS resin, AES resin, AAS resin, MBS resin, ABSM resin and the like may be listed as the styrene resin.

(2) Plating

The inner wall faces of the groove forming sections 26 in the waveguide units 20 and 21, that is, the inner wall faces of the waveguide 10 are coated with the metal plating 40. The plating may be of gold, nickel, or copper.

(3) Molding of Resin Cover

After joining the pair of the waveguide units 20 and 21, in which the through holes have been formed, together, the pair of the waveguide units 20 and 21 joined together are arranged in a mold of a cavity shape corresponding to that of the waveguide 10. Then, the resin cover 30 that comprises, as shown in FIG. 3, portions 31 filled into the through holes 25, and portions 33 that cover the entire outer side faces of the waveguide units 20 and 21 is formed by insert molding executed using a thermoplastic resin material such as engineering plastics with excellent weather-resistance. By the resin cover 30, the pair of the waveguide units 20 and 21 are fastened from the outside, and wind and rain are prevented from entering into the inside of the waveguide 10. Polycarbonate resin, liquid crystal polyester resin, AES resin, acrylate resin and the like may be listed as the engineering plastics.

In this second embodiment, after the through holes 25 are formed on the flange portions 23 of the waveguide units 20 and 21 formed of the resin, and the pair of the waveguide units, in which the through holes 25 are formed, are joined together, insert molding of the pair of the joined waveguide units 20 and 21 is executed using a thermoplastic resin to form the resin cover 30. By the resin cover 30, the waveguide units 20 and 21 are fastened from the outside, and the matching faces 22 of the waveguide units 20 and 21 are also configured to be protected from, for example, wind and rain at the outside. Accordingly, assembling of the waveguide without using screws can be realized, and assembling efficiency may be improved, based on the second embodiment. Furthermore, the fastening force between the waveguide units 20 and 21 is increased, and the air-tightness and the electrical sealing may be improved, as the contact pressure between the matching faces 22 is increased by shrinkage of the resin filled into the through holes 25. In addition, the inner wall faces of the hollow portion in the waveguide may be reliably plated as the resin material used for the waveguide units 20 and 21 is configured to be a resin material with excellent adhesion for plating such as the styrene resin.

Third Embodiment

FIG. 4 shows a waveguide 10 according to the third embodiment of the present invention. FIG. 4 shows a cross sectional view taken in the direction along the longitudinal direction of a groove of the waveguide 10. This waveguide 10 also comprises the waveguide units 20 and 21, and the resin cover 30 that surrounds and covers the waveguide units 20 and 21.

In the third embodiment, after the pair of the waveguide units 20 and 21, in which through holes have been formed, are joined together, the conducting plates 71 (for example, oxygen-free copper plates) with a rectangular opening portion corresponding to a waveguide and the both end faces of the waveguide units in the longitudinal direction are joined together.

The waveguide units 20 and 21 in which the conducting plates 71 are joined at the both end faces are arranged in a mold of a cavity shape corresponding to that of the waveguide 10. Subsequently, insert molding of the waveguide units 20 and 21 is executed using a thermoplastic resin such as a polycarbonate resin with excellent weather-resistance to form the resin cover 30 in which the through holes 25 are filled, and the portions 32 (refer to FIG. 3) covering the outer side faces are included as shown in FIG. 4.

As described above, according to the third embodiment, wind and rain may be prevented from entering into the inside of the waveguide 10, and the electrical sealing may be prevented from damage, as the pair of the waveguide units 20 and 21 are fastened from the outside, and, at the same time, the conducting plates 71 joined to the end faces of the waveguide units are done through the resin cover 30.

Though a case for manufacturing the waveguide in which the conducting plates 71 are added to the configuration of the second configuration has been explained in the description, a waveguide in which the conducting plates 71 are added to the configuration of the first configuration may be configured to be manufactured. Even in this third embodiment, a resin material used for the waveguide units 20 and 21 may be a resin material with excellent adhesion for plating such as the styrene resin (for example, ABS), is listed in the second embodiment. Moreover, though a case such that the oxygen-free copper plate has been used for the conducting plates 71 has been explained in the third description, a plate obtained by plating another metal plate such as an aluminum one, an iron one, or a SUS one, or a resin plate may be applied.

Fourth Embodiment

Figure 5:
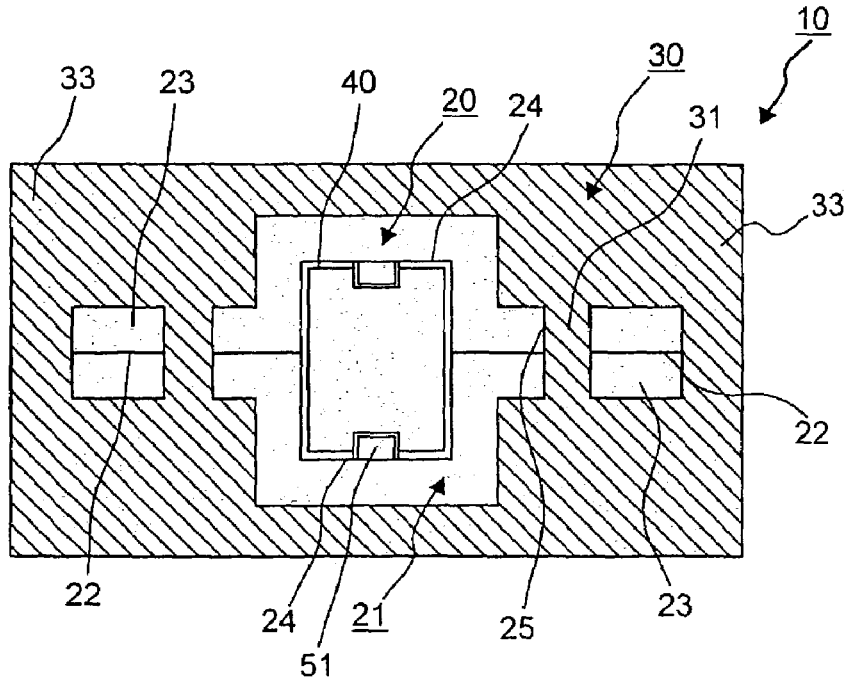
FIG. 5 is a cross sectional view of a rectangular waveguide manufactured according to a fourth embodiment of the present invention.

FIG. 5 shows a waveguide 10 according to the fourth embodiment of the present invention. This rectangular waveguide 10 also comprises the waveguide units 20 and 21, and the resin cover 30 that surrounds and covers the waveguide units 20 and 21.

In this fourth embodiment, protrusions 51 are provided on the inner faces of the waveguide units 20 and 21 to correct form errors in a groove after assembling and to reduce the space volume of the groove. The other portions except the portions are similar to those of the previous second embodiment.

The waveguide 10 shown in FIG. 5 is manufactured with the following method. That is the waveguide units 20 and 21 with the groove 24, the protrusions 51, and the through holes 25 are formed by injection molding. A resin material used for the waveguide units 20 and 21 may be a resin material with excellent adhesion for plating such as the styrene resin (for example, ABS), which is listed in the second embodiment. Thereafter, the waveguide 10 is manufactured by plating and molding of the resin cover 30 using the same material and the same method with those of the second embodiment. Here, recesses, instead of the protrusions 51, may be configured to be formed.

Figure 6:
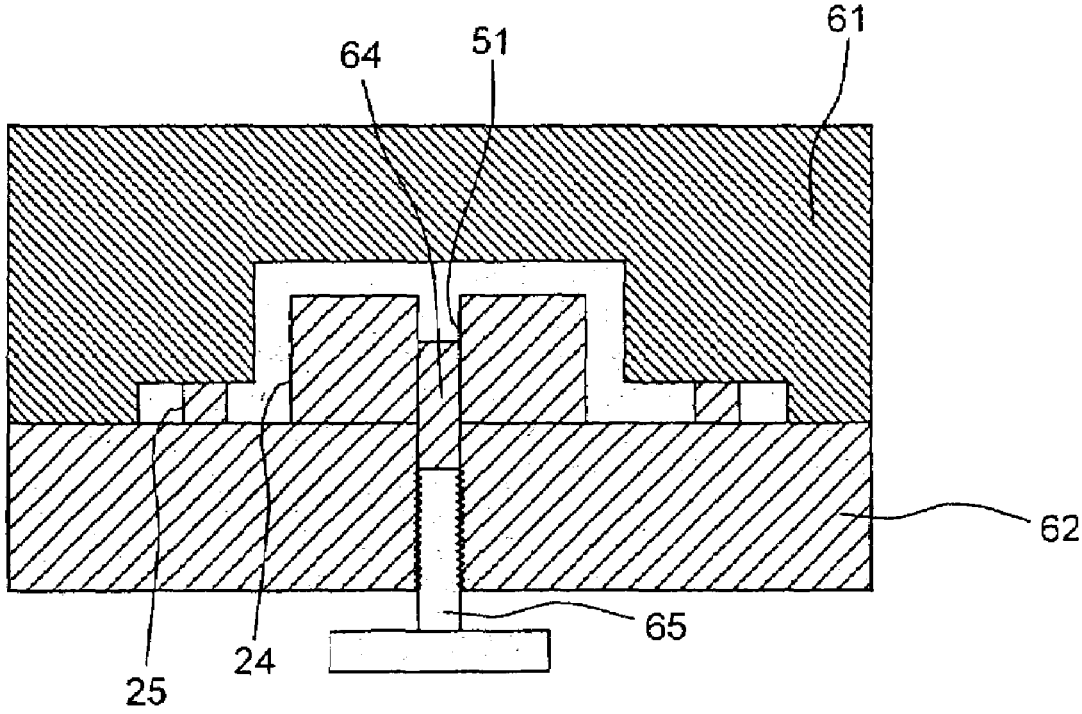
FIG. 6 is a cross sectional view that shows a mold with which the rectangular waveguide shown in FIG. 5 is manufactured.
Figure 7:
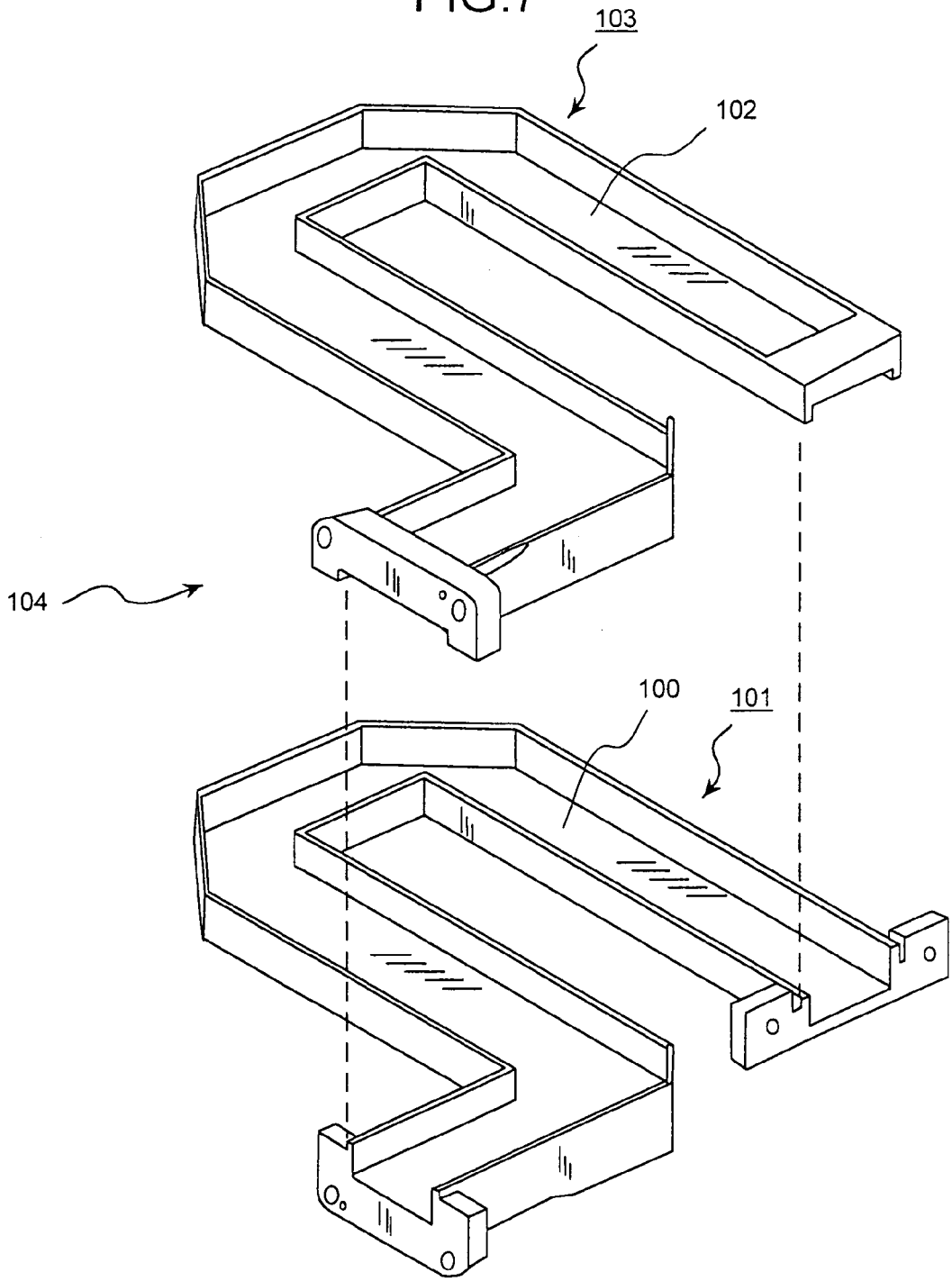
PRIOR ART FIG.7
FIG. 7 is a perspective view of the prior art microwave waveguide.

FIG. 6 shows a cross section of a mold by which injection molding of the waveguide units 20 and 21 with the groove 24, the protrusions 51, and the through holes 25 shown in FIG. 5 is executed.

The mold is provided with a movable insert 64, and a position-adjusting screw 65 in addition to an upper mold 61, and a lower mold. The insert 64 is provided in the lower mold 62 to form the protrusions 51. The positioning-adjusting screw 65 is connected to the insert 64, and the position of the insert 64, that is, the heights of the protrusions 51 may be adjusted by turning the positioning-adjusting screw 65.

In this mold, the position of the movable insert 64 is adjusted with the insert-adjusting screw 65 provided in the lower mold 62 for fixing at an adjustment position to reduce the space volume in the inside of the groove, or to form a space corresponding to an increase amount of the space volume, and, then, form errors of the groove for the waveguide caused by molding shrinkage of a resin used for the waveguide and by molding of the resin cover 30 is corrected. Thereafter, the upper mold 61 and the lower mold 62 are closed, and insert molding is executed to form the waveguide units 20 and 21 provided with the protrusions 51 (or recesses) in the inside of the groove for the waveguide.

In this fourth embodiment, similar effects to those of the second embodiment may be obtained. Moreover, when it is required to adjust the space volume in the inside of the groove to correct form errors of the groove caused by resin shrinkage at insert molding of the waveguide units and by deformation of the waveguide unit at molding of an exterior component (the resin cover 30), an adjusting work by which, for example, a screw hole is added after molding of the resin cover 30 and a screw is forced into the hole is not required, as the protrusions (or, recesses) with a space volume necessary for adjusting are provided in the groove of the waveguide units. Accordingly, time to manufacture the waveguide may be reduced.

When the waveguide units are manufactured using the mold provided with the movable insert to form the protrusions or recesses, the productivity of manufacturing the waveguides is improved as the waveguide obtained after manufacturing is not required to individually be adjusted with, for example, a screw.

Fifth Embodiment

As the fifth embodiment of the present invention, an unsaturated polyester resin (for example, RIGOLAC BMC, RNC413 made by Showa Highpolymer Co., Ltd.), which is obtained by mixing from 5 to 10% polystyrene resin, from 10 to 20 weight % glass fiber, and 60 weight % calcium carbonate, is used to form waveguide units 20 and 21. Thereafter, the resin cover 30 is formed in a similar manner to that of the second embodiment. As the unsaturated polyester resin can be used for insert molding, the productivity of manufacturing the waveguide units is not decreased. Moreover, as the unsaturated polyester resin has a small molding shrinkage percentage, and excellent creep resistance, form errors of a groove for a waveguide after the resin cover 30 has been molded may be prevented from enlarging.

Sixth Embodiment

A sixth embodiment of the present invention is explained. In the sixth embodiment, after waveguide units 20 and 21 are formed in a similar manner to the manufacturing method of the second embodiment, cast molding of a thermosetting resin such as an epoxy resin (for example, an epoxy-resin principal ingredient XNR4153P/a hardening agent XNH4153 made by Vantico), which is obtained by mixing from 60 to 80% silicon dioxide, is executed to form the resin cover 30.

Form errors of a groove for a waveguide at forming the resin cover 30 may be prevented from enlarging, as injecting pressure is not applied in a manufacturing method using the thermosetting resin such as the epoxy resin on the waveguide units insert-molded.

Though the side faces 28 (refer to FIG. 2) of flange portions 23 in the waveguide units 20 and 21 have been also covered by the resin cover 30 in the embodiments, the side faces 28 may be exposed. But the weather-resistance of a waveguide 10 against wind and rain would be reduced in such a case. That is, the resin cover 30 may be formed in such a way that the through holes 25 are filled and at least the outer faces facing matching faces 22 of the flange portions 23 are covered.

A material used for the waveguide units 20 and 21 may be an arbitrary metal or resin. Moreover, though the present invention has been applied for a rectangular waveguide in the embodiments, the present invention may be also applied for a circular waveguide.

A waveguide that has made using the manufacturing method according to the present invention may be applied not only for a microwave transmitter-receiver shown in FIG. 1 and is used for satellite communication, but also for other arbitrary communication devices, and electronic devices.

INDUSTRIAL APPLICABILITY

The present invention is preferably used for a waveguide included in a duplexer and the like in a microwave antenna provided in a ground station for satellite communication.

The invention claimed is:

1. A method of manufacturing a waveguide, wherein the waveguide includes two waveguide units that are joined together, each waveguide unit having flanges at respective sides, such that the flanges of a first of the waveguide units abut the flanges of a second of the waveguide units, each waveguide unit having a groove at a center for guiding waves, inner walls of the groove being metal-plated, the method comprising:

forming the first and second waveguide units so the flanges have through holes; and forming a resin cover that fills the through holes and covers both the first and second waveguide units, at least partially, by, after joining the first and second waveguide units, insert molding the two waveguide units with a thermoplastic resin.

2. The manufacturing method according to claim 1, wherein the first and second waveguide units are made of a resin, and the resin cover covers all outer surfaces of both of the first and second waveguide units.

3. The manufacturing method according to claim 1, wherein, after the first and second waveguide units are joined, joining end faces of the joined waveguide units and the resin cover with a conductive plate having a rectangular opening corresponding to the waveguide, and filling the through holes by insert molding the joined waveguide units and the conductive plate with a thermoplastic resin.

4. The manufacturing method according to claim 1, including forming a projection or a recess on an inner face of the groove in forming the through holes in the flanges.

5. The manufacturing method according to claim 4, including forming the waveguide units using a mold having a movable insert for forming the projection or the recess.

6. The manufacturing method according to claim 1, wherein the waveguide units include a styrene resin.

7. The manufacturing method according to claim 1, wherein the waveguide units include an unsaturated polyester resin.

8. The manufacturing method according to claim 1, wherein the resin cover includes an engineered plastic resistant to weather.

9. The manufacturing method according to claim 1, wherein the resin cover includes a thermosetting resin.

10. A method of manufacturing a waveguide comprising:

forming two waveguide units, each waveguide unit having a channel defined by a bottom wall and two side walls generally transverse to the bottom wall, flanges extending from the side walls, outside the groove, transverse to the side walls and generally parallel to the bottom wall, the flanges including through holes;

joining the two waveguide units to each other so that the flanges of a first of the waveguide units abut the flanges of a second of the waveguide units, with the grooves forming a channel for guiding waves; and by insert molding, forming a thermoplastic resin cover that fills the through holes in the flanges and covers both of the first and second waveguide units, at least partially.

11. The manufacturing method according to claim 10, wherein the waveguide units include a styrene resin.

12. The manufacturing method according to claim 10, wherein the waveguide units include an unsaturated polyester resin.

13. The manufacturing method according to claim 10, wherein the resin cover includes a thermosetting resin.

14. The manufacturing method according to claim 10, wherein the first and second waveguide units have joining end faces transverse to the side walls and the bottom walls, including applying an electrically conductive plate having a rectangular opening corresponding to the channel to the joining end faces, and covering side surfaces of the conductive plate with the thermoplastic resin in the insert molding.

15. The manufacturing method according to claim 10, including forming a projection or a recess on an inner face of the bottom wall of at least one of the waveguide units in forming the waveguide unit.

16. The manufacturing method according to claim 15, including forming the waveguide units in a mold having a movable insert for forming the projection or the recess.

* * * * *